US011408277B2

(12) United States Patent
Guzman

(10) Patent No.: US 11,408,277 B2
(45) Date of Patent: Aug. 9, 2022

(54) ASSEMBLY, INDICATING DEVICE, AND METHOD FOR INDICATING WINDOW MILLING IN A WELL

(71) Applicant: SAUDI ARABIAN OIL COMPANY, Dhahran (SA)

(72) Inventor: Julio C. Guzman, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/082,662

(22) Filed: Oct. 28, 2020

(65) Prior Publication Data

US 2022/0127952 A1 Apr. 28, 2022

(51) Int. Cl.

| | |
|---|---|
| ***E21B 47/09*** | (2012.01) |
| ***E21B 23/01*** | (2006.01) |
| ***E21B 29/06*** | (2006.01) |
| ***E21B 23/06*** | (2006.01) |

(52) U.S. Cl.

CPC ..... *E21B 47/09* (2013.01); *E21B 23/01* (2013.01); *E21B 23/06* (2013.01); *E21B 29/06* (2013.01)

(58) Field of Classification Search

CPC ..... E21B 47/09; E21B 23/01; E21B 23/06; E21B 29/06; E21B 7/061; E21B 41/0035; E21B 7/06

See application file for complete search history.

(56) References Cited

U.S. PATENT DOCUMENTS 3,116,799 A 1/1964 Lemons
3,908,759 A 9/1975 Cagle et al.
5,445,222 A 8/1995 Pritchard et al.
5,474,126 A 12/1995 Lynde et al.
5,595,247 A * 1/1997 Braddick ..... E21B 7/061 166/117.6
5,657,820 A * 8/1997 Bailey ..... E21B 29/06 166/117.6

(Continued)

FOREIGN PATENT DOCUMENTS

CA 2963231 C 4/2019

OTHER PUBLICATIONS

International Search Report and Written Opinion of the International Searching Authority issued in corresponding International Application No. PCT/US2021/056989, dated Jan. 18, 2022 (12 pages).

*Primary Examiner* — Daniel P Stephenson
(74) *Attorney, Agent, or Firm* — Osha Bergman Watanabe & Burton LLP

(57) ABSTRACT

An assembly for indicating a window milling progress and a casing exit trajectory in a well may include a cylindrical housing having an inclined plane that extends along a central axis thereof. The inclined plane may extend from a lower end to an upper end of the cylindrical housing. The assembly may include an indicating device. The indicating device may include a cylindrical body having a surface that faces in a downward direction. The indicating device may include a plurality of anchor slips located on a curved rectangular side of the cylindrical body. The indicating device may include a set of inserts located at predetermined locations along a length of the curved rectangular side of the cylindrical body. The assembly may include a coupling mechanism that connects the indicating device to the cylindrical housing.

16 Claims, 11 Drawing Sheets

(56) References Cited

U.S. PATENT DOCUMENTS

| | | | | |
|---|---|---|---|---|
| 5,709,265 | A * | 1/1998 | Haugen | E21B 7/061 166/117.6 |
| 5,775,428 | A * | 7/1998 | Davis | E21B 7/061 166/117.6 |
| 6,105,675 | A | 8/2000 | Buytaert et al. | |
| 6,786,283 | B2 * | 9/2004 | Freeman | E21B 7/061 166/298 |
| 9,863,232 | B2 * | 1/2018 | Vuyk, Jr. | E21B 44/00 |
| 2007/0125550 | A1 * | 6/2007 | Campbell | E21B 23/01 166/382 |
| 2014/0360723 | A1 * | 12/2014 | Utter | E21B 41/0035 166/298 |
| 2015/0027714 | A1 | 1/2015 | Parlin | |

* cited by examiner

ASSEMBLY, INDICATING DEVICE, AND METHOD FOR INDICATING WINDOW MILLING IN A WELL

BACKGROUND

Whipstock tracking may occur during milling operations. For example, a drill bit may drill through the body of a whipstock for performing milling operations at an angle with respect to an original direction of a well. Similarly, casing in a wellbore may be drilled through at different angles depending on whether the whipstock is milled through. In cases where milling is performed through the whipstock, it is fundamental for milling operations to maintain milling at an angle. Otherwise, milling may be stuck in an original direction without breaking the casing in the wellbore and without clearly developing a window for milling, exiting the casing, and creating a new wellbore.

SUMMARY

Milling windows to exit existing wellbores is a technique used to maximize the commercial use of wells in the oil and gas industry. The window milling process enables an oil and gas operator to either access by-passed producing zones, continue drilling around a mechanical obstacle, or maximize reservoir contact by drilling lateral branches from a main wellbore. To create and exit in the existing casing, milling tools are used. It is also standard to use a deviation device, or whipstock, that pushes the milling tools in a desired direction to mill and destroy the casing to exit into the rock, creating a new wellbore.

Sometimes, due to certain conditions of the existing wellbore, the milling assembly will take an undesired trajectory and starts tracking the existing wellbore. In this case, the milled trajectory finds it easier to follow the existing casing. The whipstock does not create the required lateral push to send the milling assembly out of the existing wellbore. Therefore, the milling also acts on the lower part of the whipstock assembly (i.e., where anchoring and packer components are located) and partially cuts it.

This above situation is difficult to detect from surface. The milling parameters do not offer enough margins for distinguishing a casing tracking problem and the byproducts returning to surface are very similar to a normal window milling operation (i.e., metal debris, some cement, and some rock cuttings). Casing tracking may be caused by hard rock outside of the casing 255, poor cement composition, or bad/corrode casing.

As a result of the casing tracking problem, the directional drilling assembly and drilling bit use in subsequent operations follow the casing track started by the milling assembly. As these drilling tools are not designed for milling the metal of the casing, it results in non-reparable damages to the expensive drilling bits and in the worst cases, the loss of the even more expensive directional tools in the hole. Additionally, time is spent in the diagnosis of the problem and the recovery operation to mill a proper window.

In view of the above, one or more embodiments of the present invention are directed towards equipping the whipstock assembly with a set of markers that allow early identification of the casing tracking problem and provide information needed to avoid expensive equipment damage and to optimize recovery operations.

In general, in one aspect, embodiments disclosed herein relate to an assembly for indicating window milling in a well. The assembly includes a cylindrical housing having an inclined plane that extends along a central axis thereof. The inclined plane extends from a lower end to an upper end of the cylindrical housing. The assembly includes an indicating device. The indicating device includes a cylindrical body having a surface that faces in a downward direction. The indicating device includes a plurality of anchor slips located on a curved rectangular side of the cylindrical body. The indicating device includes a first insert located at a first predetermined location along a length of the curved rectangular side of the cylindrical body. The assembly includes a coupling mechanism that connects the indicating device to the cylindrical housing.

In general, in one aspect, embodiments disclosed herein relate to an indicating device for indicating window milling in a well. The indicating device includes a cylindrical body having a surface that faces in a downward direction. The indicating device a plurality of anchor slips located on a curved rectangular side of the cylindrical body. The indicating device includes a first insert located at a first predetermined location along a length of the curved rectangular side of the cylindrical body. The indicating device connects to a cylindrical housing through a coupling mechanism. The cylindrical housing has an inclined plane that extends along a central axis thereof, the inclined plane extending from a lower end to an upper end of the cylindrical housing.

In general, in one aspect, embodiments disclosed herein relate to a method for indicating window milling in a well. The method includes obtaining an assembly having an inclined plane that causes a deployment device to deflect from a central axis at an angle, the assembly extending along the central axis thereof. The method includes lowering the assembly into the wellbore using a deployment device coupled to a conveyance mechanism, the conveyance device translating the deployment device vertically, or in an original direction, along the wellbore. The method includes determining a depth of a surface of the assembly that faces in a downward direction, the assembly including at least one insert representative of a predetermined location along a length of the assembly. The method includes releasing the assembly when the depth of the surface is equal to a predetermined depth of the wellbore, the assembly being released by the conveyance mechanism. The method includes gradually rotating and lowering the conveyance mechanism, the conveyance mechanism causing the deployment device to engage an upper end of the assembly. The method includes directing an operation of the conveyance mechanism in a direction of the angle. The method includes monitoring byproduct of the operation of the conveyance mechanism in the direction of the angle.

Other aspects of the disclosure will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
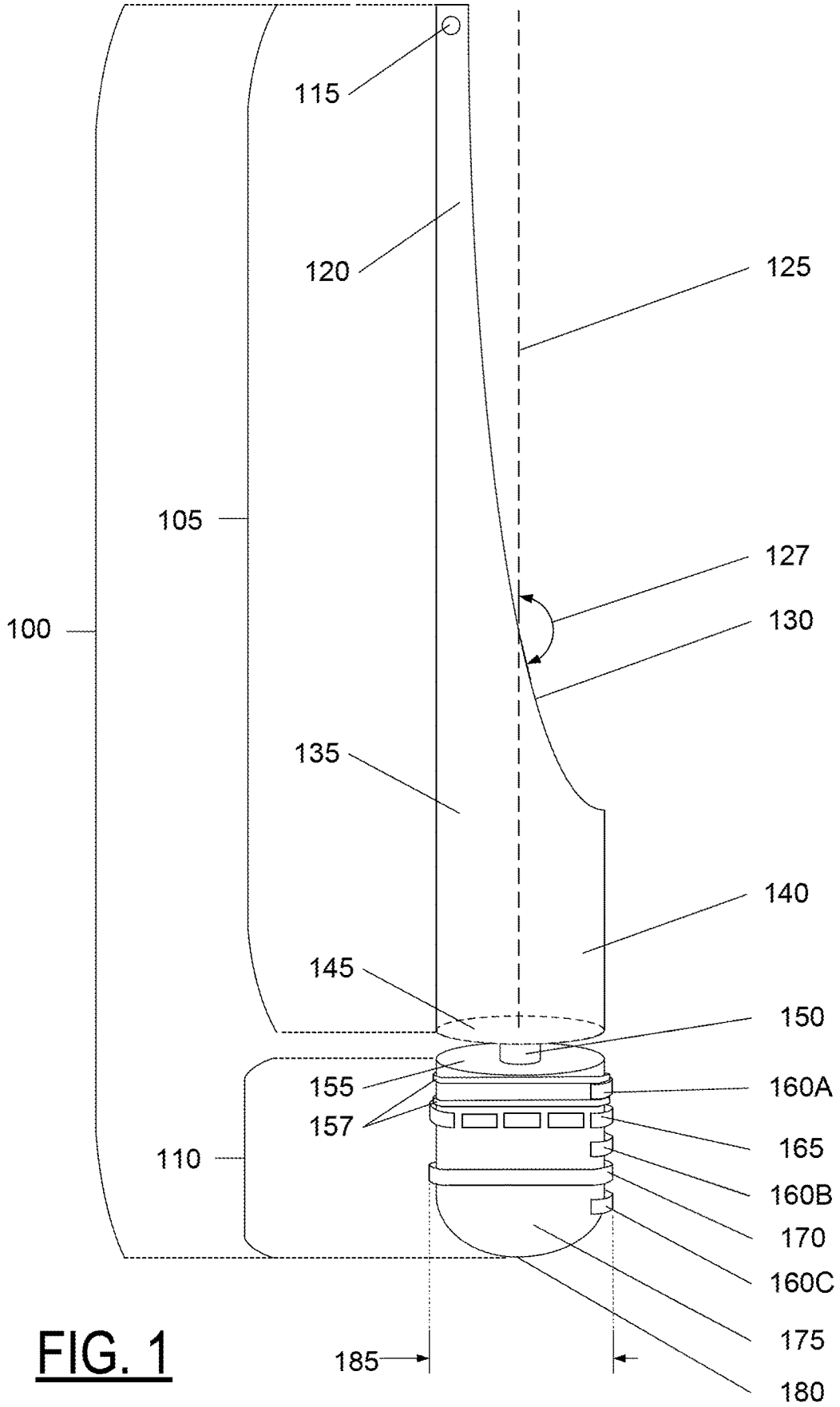
FIG. 1 shows a schematic diagram of an assembly in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include an assembly (i.e., a whipstock), an indicating device, and a method for indicating window milling in a well. The assembly includes the indicating device at a lower end facing a downward direction. The indicating device includes various inserts that may be color-coded or texture-coded to indicate a milling path through the indicating device. The inserts may break during milling operations when the milling operations break through the indicating device (i.e., this phenomenon is known as casing tracking). As byproduct from the milling operations rises to a rig surface, broken insert portions may be observed using the naked eye, sensors, and/or filtering systems dedicated to identify the colors and textures associated with the inserts. A milling path of the window milling may be calculated based on the specific inserts identified. The specific inserts help to determine whether the window has been milled in an intended direction or casing tracking has occurred. In addition, the specific inserts indicate a level of severity of the casing tracking in relation to a specific depth of the specific insert identified.

In some embodiments, the assembly includes a flat surface that acts as an inclined plane or a ramp. The flat surface is an inclined plane that forms an angle with respect to a central axis of the assembly. The assembly may be the combination of a cylindrical housing and the indicating device coupled to one another through a coupling mechanism. The inserts may be secured to the indicating device by bonding agent and engraved with securing plates. The protruding part of the inserts may be configured to not exceed a maximum outer diameter of the assembly. The inserts may be aligned with a face of the inclined plane. The material for the inserts may be nitrile butadiene rubber or an equivalent material.

In one or more embodiments, the method for indicating window milling in a well includes monitoring the byproduct (i.e., returning flow) from milling operations and searching for the insert debris. Once specific colors or textures associated to specific inserts are identified, the milling depth for the milling window may be calculated. Further, it may be possible to determine whether the milling operation took an undesired path of following the existing wellbore or the milling operation was properly milled and achieved exiting an existing casing as intended. In some embodiments, the inserts may be at least three inserts colored or texturized to indicate three types of window milling. A first insert may indicate that the window milling was properly cut and a rat-hole was drilled mainly outside the wellbore. A second insert may indicate that partial tracking has occurred in the assembly. A third insert may indicate that most of the indicating device was milled out and that severe tracking has occurred in the assembly.

In some embodiments, the early indications of tracking in the assembly may allow for proper planning of next steps in the milling operations. These next steps may be to avoid any additional damage of expensive drilling bits and may be to reduce time required to perform remedial operations. Timing for implementing sidetracks for re-entering existing wellbores and target new zones in same or different reservoirs may be greatly improved as a result. Specifically, traditional re-entry operations may require between 6 to 8 days to diagnose and fix when severe tracking occurs in milling operations (i.e., significant time is spent trying to understand what is going on and why drilling cannot progress into the new wellbore). In some embodiments, re-entry operations may be fixed in under a couple of days using the assembly and the indicating device described herein.

FIG. 1 shows a schematic diagram illustrating an assembly 100. The assembly 100 includes an indicating device 175 located therewith configured to add anchoring weigh to a bottommost portion of the assembly 100. In some embodiments, the assembly 100 has a cylindrical housing 135 coupled to the indicating device 175 through a coupling mechanism 150. The cylindrical housing 135 may include an inclined plane 130 that extends from a lower end 140 to an upper end 120 of the cylindrical housing 135. As such, the inclined plane 130 may be a ramp surface that is disposed at an angle 127 with respect to a central axis 125 of the cylindrical housing 135. As ramp surface, the assembly 100 may include the inclined plane 130 in a portion of the entirety of a length 105 of the cylindrical housing 135. In some embodiments, the cylindrical housing 135 includes a shearing bolt 115 disposed at a topmost portion of the assembly 100. The shearing bolt 115 may be a connecting element through which the assembly 100 is translated vertically along a wellbore 257 of a well 207. An outer diameter 145 of the cylindrical housing 135 may be equal to spacing available in the wellbore 257 as limited by any casing 255. The inclined plane 130 allows the milling assembly to achieve a desired deviation by pushing the entire milling assembly towards the casing 255.

In some embodiments, the indicating device 175 includes a cylindrical body 155 with at least one surface 180 that faces in a downward direction. The indicating device 175 may include various embedded elements in the cylindrical body 155. In some embodiments, the embedded elements include various anchor slips 165 that aid in providing a stable platform for the assembly 100 to handle any required load and torque during milling operations. The indicating device 175 may include a packer 170 that seals any spacing between the assembly 100 and the casing 255 of the wellbore 257. An outer diameter 155 of the indicating device 175 may be equal to spacing available in the wellbore 257 as limited by any casing 255. Further, an outer diameter 155 of the assembly 100 may be equal or larger than the outer diameter 145 of the cylindrical housing 135. A length 110 of the indicating device 175 may be equal or smaller than the length 105 of the cylindrical body 155. The length 105 and the length 110 are based on an application profile which provides requirements for milling operations involving the assembly 100. In this regard, a length of the entire assembly 100 may be between 6 ft and 10 ft, inclusive.

In one or more embodiments, the indicating device 175 may include one or more inserts 160A, 160B, and 160C. The inserts 160A-160C may be color-coded or texture-coded to indicate a specific depth of the indicating device 175. The inserts 160A-160C may break during milling operations when the milling operations is performed through the indicating device 175. As byproduct from the milling operations rises to a rig surface 230, broken inserts 610, 710, and 810 may be observed using the naked eye, sensors 215, and/or control system 225 dedicated to identify the colors and the textures associated with the inserts 160A-160C. A milling path of the window milling may be calculated based on the specific inserts identified. The inserts 160A-160C may be secured to the indicating device 175 by bonding agent and engraved with securing plates. The protruding part of the inserts 160A-160C may be configured to not exceed a maximum outer diameter 185 of the assembly. In this regard, the outer diameter 155 of the indicating device 175 may be equal or larger than the outer diameter 145 of the cylindrical housing 135. Further, the securing plates may be engraved at ⅝ inches with a protrusion of ⅛ inches. The inserts 160A-160C may be aligned with a curved rectangular side of the inclined plane 130. The inserts 160A-160C may be made of nitrile butadiene rubber or an equivalent material including characteristics such as higher hardness, strength, abrasion resistance, heat resistance, and oil/fuel resistance and lower resilience and low temperature flexibility.

In some embodiments, the inserts 160A-160C may be at least three inserts colored or texturized to indicate three types of window milling. A first insert 160A may indicate that the window milling was properly cut and a rat-hole was drilled mainly outside the wellbore 257. A second insert 160B may indicate that partial tracking has occurred in the assembly. A third insert 160C may indicate that most of the indicating device 175 was milled out and that severe tracking has occurred in the assembly. The inserts 160A-160C may have a length between 4 inches and 12 inches, inclusive. The inserts 160A-160C may include securing rings 157 that retain (i.e., secure) any or all of the inserts in a given depth of the indicating device 175. For example, the securing rings 157 may be used for securing the insert 160A at a distance of 1 foot from an uppermost portion of the indicating device 175. In this regard, a single securing ring 157 may be implemented to protect an upper portion of the packer 170. Further, the packer 170 may also include a color-coded rubber insert to aid in early identification of casing tracking. The colors used for the inserts 160A-160C and the packer 170 may be different and distinct such that each of these colors may represent a specific depth of the indicating device 175.

Figure 2:
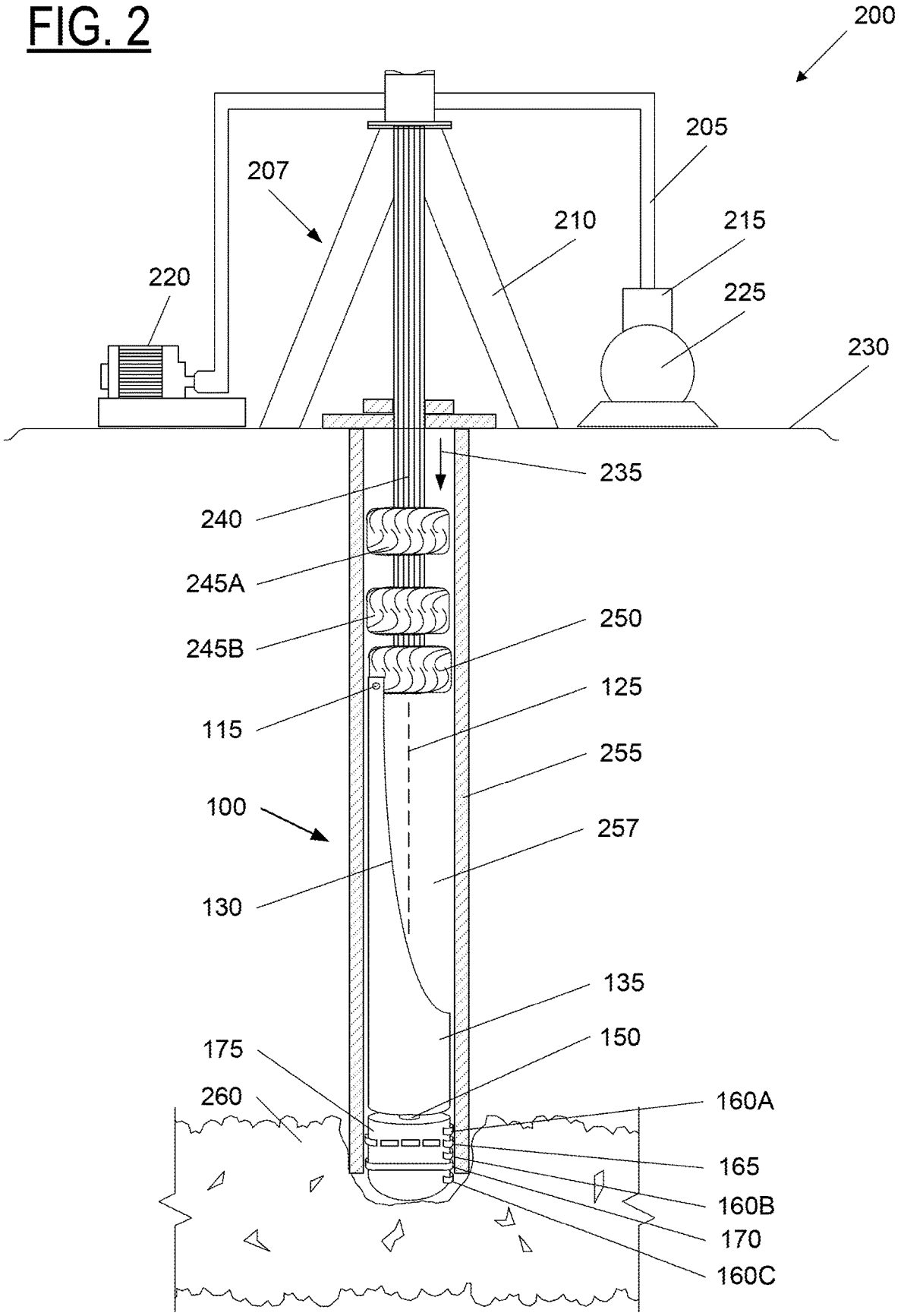
FIG. 2 shows a schematic diagram of a system including an assembly during a milling operation in accordance with one or more embodiments.

FIG. 2 shows a schematic diagram illustrating the assembly 100 disposed on the wellbore 257 of a well system 200 according to one or more embodiments. The well system 200 may include surface equipment including actuating devices 220, the sensors 215, and control system 225 connected to one another using hardware and/or software to create interfaces 205. Further, the well system 200 may be propped by structures 210 from the rig floor 230. The well system 200 includes the wellbore 257 extending from the rig surface 230 to an underground formation 260. The underground formation 260 may have porous areas including hydrocarbon pools that may be accessed through the wellbore 257. In some embodiments, the assembly 100 is translated in an original direction along the wellbore 257 using the surface equipment.

The well system 200 includes the well 207 extending below the earth surface into the underground formation ("formation") 260. The formation 260 may include a porous or fractured rock. A subsurface pool of hydrocarbons, such as oil and gas, also known as a reservoir, may be located in the formation 260. The well 207 includes the wellbore 257 that extends from a wellhead at the surface to a target zone in the formation 260—the target zone may be where the reservoir (not shown separately) is located. Well 207 may further include the casing 255 lining the wellbore 257. In the illustrated example, casing 255 extend into the portion of wellbore 257 penetrating the formation 260. In other implementations, the portion of wellbore 257 penetrating formation 260 may be uncased or open, and fluid communication between formation 260 and well 207 may occur through an open wall section of the well 207.

The wellbore 257 may facilitate the circulation of drilling fluids during drilling operations. The flow of hydrocarbon production ("production") (e.g., oil and gas) from the reservoir to the surface during production operations, the injection of substances (e.g., water) into the formation 260 or the during injection operations, or the communication of monitoring devices (e.g., logging tools or logging devices) into the formation 260 or the reservoir during monitoring operations (e.g., during in situ logging operations).

The well system 200 may include a well control system ("control system") 225. In some embodiments, the control system 225 may collect and record wellhead data for the well system 200. The control system 225 may include flow regulating devices that are operable to control the flow of substances into and out of wellbore 257. In some embodiments, the control system 225 may regulate the movement of the conveyance mechanism 240 by modifying the power supplied to the actuating devices 220. The conveyance mechanism 240 may be a fishing line or a fishing tool coupling the assembly 100 to the structures 210. The conveyance mechanism 240 may be a special mechanical device used to aid the deployment of re-entry or milling operations in the well 207.

In some embodiments, the actuating devices 220 may be motors or pumps connected to the conveyance mechanism 240 and the control system 225. The control system 225 may be coupled to the sensors 215 to sense characteristics of substances and conditions in the wellbore 257. Further, for example, the sensors 215 may include a surface temperature sensor including, for example, a wellhead temperature sensor that senses a temperature of returning flow through or otherwise located in the wellhead, referred to as the "wellhead temperature" ($T_{wh}$).

In some embodiments, the measurements are recorded in real-time, and are available for review or use within seconds, minutes or hours of the condition being sensed (e.g., the measurements are available within 1 hour of the condition being sensed). In such an embodiment, the wellhead data may be referred to as "real-time" wellhead data. Real-time data may enable an operator of the well system 200 to assess a relatively current state of the well system 200, and make real-time decisions regarding development of the well system 200 and the reservoir, such as on-demand adjustments in regulation of milling operations in the well 207.

In some embodiments, the conveyance mechanism 240 may include one or more watermelon mills 245A and 245B and a window mill 250 coupled to form a milling assembly. The watermelon mills 245A and 245B may be string mills positioned in a drill collar string of the conveyance mechanism 240 for milling out tight spots in the casing 255. During milling operations, the watermelon mills 245A and 245B are reamed up and down over a sidetracking portion to debar and cut clearance for subsequent casing or liner operations. The watermelon mills 245A and 245B may be dressed with tungsten carbide material. The watermelon mills 245A and 245B may be used for smoothing and cutting clearance in the pack-stock window. The watermelon mills 245A and 245B are then added to the conveyance mechanism 240 with a window mill (i.e., or a milling device 620) to make a stiffer cutting assembly and further open the window for subsequent drilling operation.

The window mill 250 may be a deployment device that is operationally coupled to the assembly 100 through the shearing bolt 115 such that any movement of the conveyance mechanism 240 causes a respective movement in the assembly 100. During the milling operations, the conveyance mechanism 240 may lower the assembly 100 into the wellbore 257 by moving the conveyance mechanism 240 in a downward direction 235. The assembly 100 may be lowered to a predetermined depth. The predetermined depth may be a depth determined by the control system 225 to be a depth for performing one or more milling operations. For example, the predetermined depth may be a depth in which the inclined plane 130 directs the milling operation in a predetermined area of the casing 255.

Figure 3:
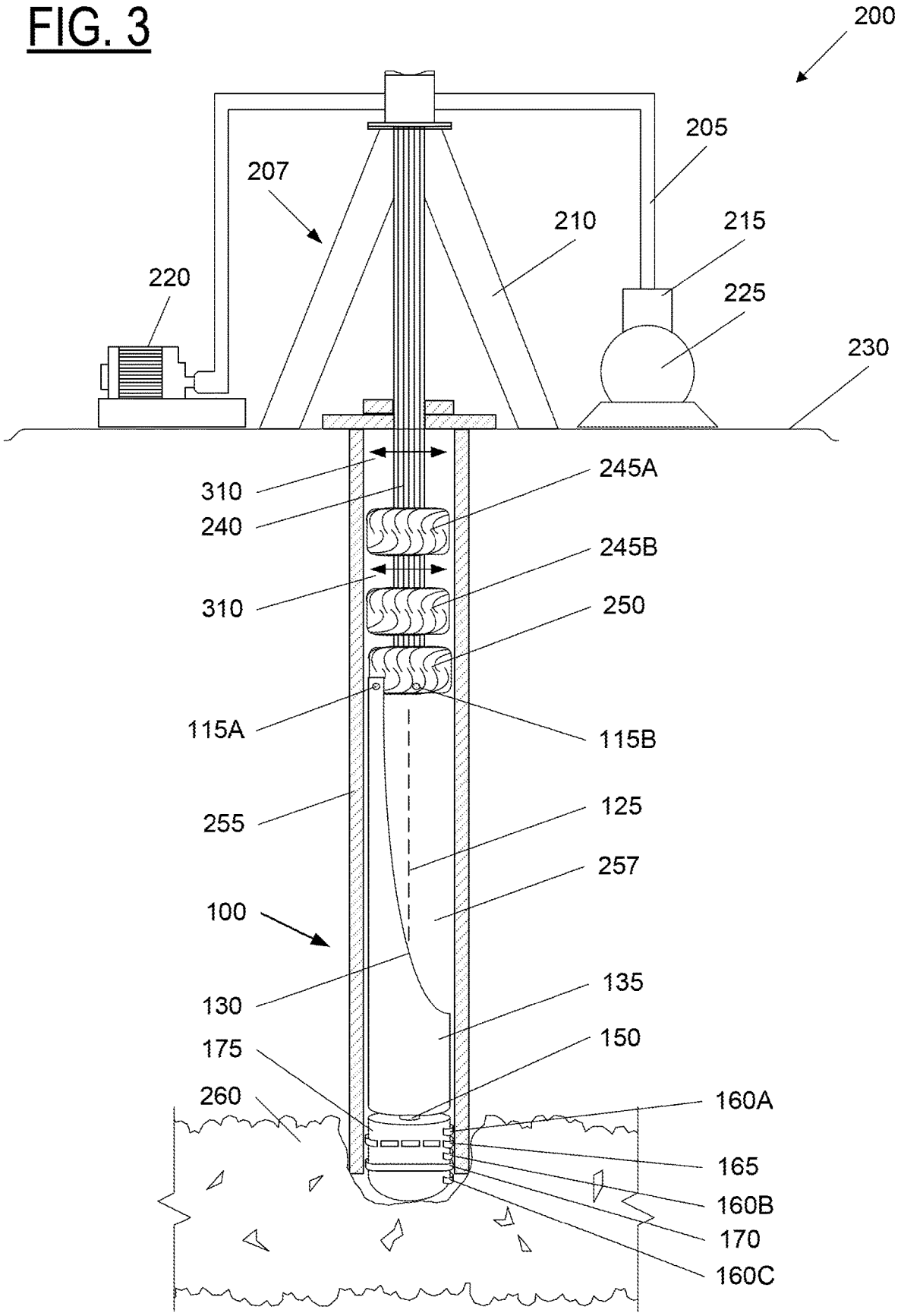
FIG. 3 shows a schematic diagram of a system including an assembly during a milling operation in accordance with one or more embodiments.

FIG. 3 shows a schematic diagram illustrating the assembly 100 being released into the wellbore 257 according to one or more embodiments. The conveyance mechanism 240 releases the assembly 100 by orienting in a direction 310. The conveyance mechanism 240 orients the bottommost portion of the assembly 100 in a desired direction along with the inclined plane 130. The assembly 100 is set hydraulically in the desired direction by activating the anchors slips 165. Once this is done, the whipstock may move up or down without rotating. The assembly 100 is released by breaking the shear bolt 115 into shear bolt elements 115A and 115B. In releasing the assembly 100 during milling operations, the assembly 100 is left to be held in the wellbore 257 by pressing the anchor slips 165 and the packer 170 against the casing 255.

Figure 4:
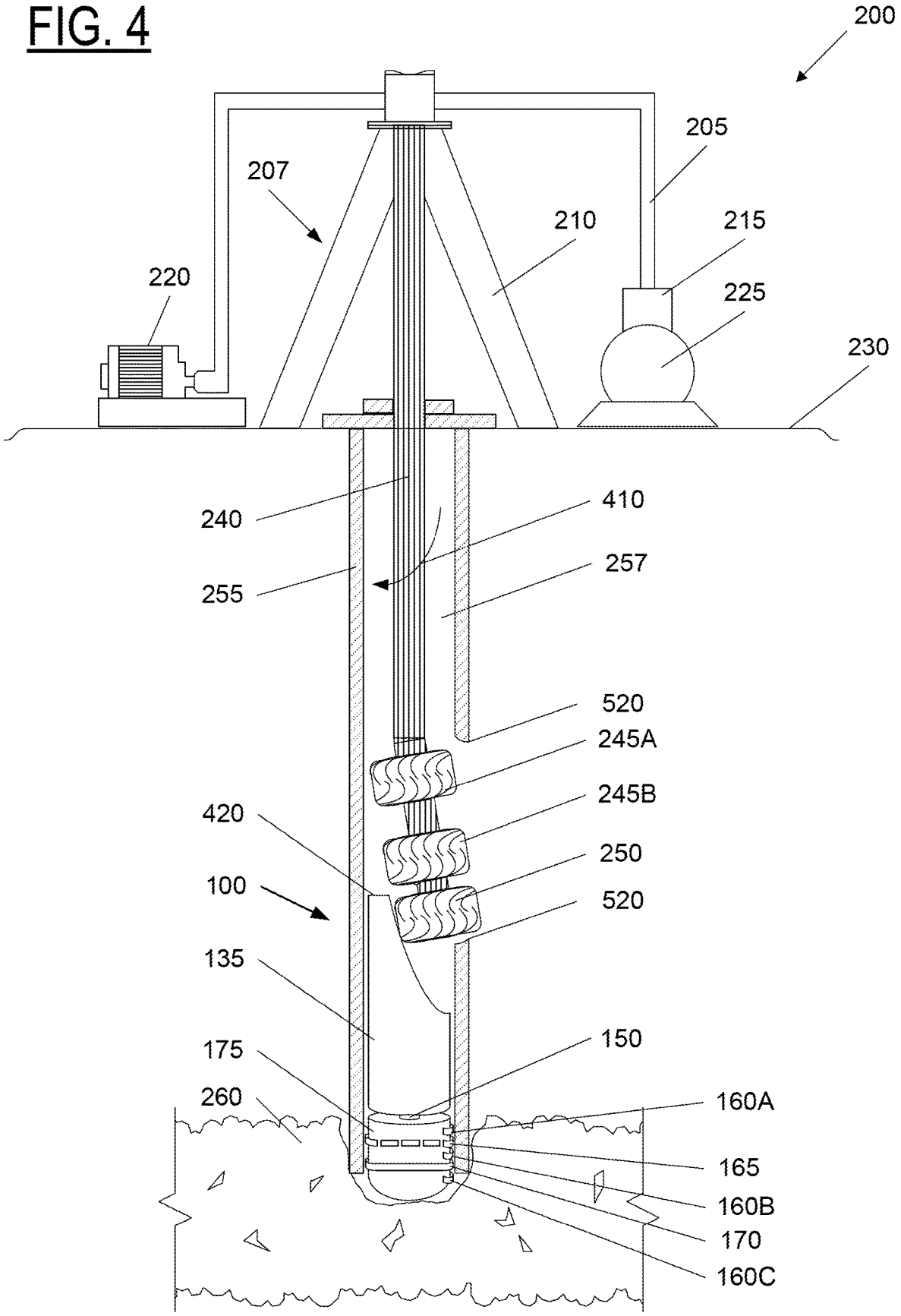
FIG. 4 shows a schematic diagram of a system including an assembly during a milling operation in accordance with one or more embodiments.

FIG. 4 shows a schematic diagram illustrating the assembly 100 during the milling operation according to one or more embodiments. The conveyance mechanism 240 gradually rotates and lowers the watermelon mills 245A and 245B and the window mill 250 as actuated by the actuating devices 220 to mill through the assembly 100. During the milling operation, a rotating direction 410 is downward and into the well 207. The milling operation lowers the milling assembly in the direction of the wellbore 257 until the window mill 250 finds a milling angle defined by the inclined plane 130. In this case, the conveyance mechanism 240 is lowered and milling commences by applying weight and rotation on the milling assembly. In one or more embodiments, the assembly 100 remains intact during ideal milling operations. In particular, the milling assembly is pushed against the casing 255 in the direction of the inclined plane 130. As the milling progresses, the trajectory that follows is defined by the interaction between the milling assembly, the assembly 100, the casing 255, cement, and rock. The casing 255 may get cut at a point that is very close to the top of the assembly 100. To this end, the window mill may be long to accommodate the passage of subsequent drilling assemblies. The length of the window mill may be between 10 feet and 15 feet, inclusive. Successful casing exits may drill a rathole in the new wellbore formed in the rock adjacent to the original wellbore 257 and without milling through the indicating device 175. This prevents the base of the assembly 100 from being milled or drilled. In FIG. 4, the window mill is shown between broken casings 520 and the rest of the assembly 100 is hidden for clarity while being represented by silhouette 420. Silhouette 420 is a representation of the assembly 100, which is hidden to increase the clarity of the drawings.

Figure 5A:
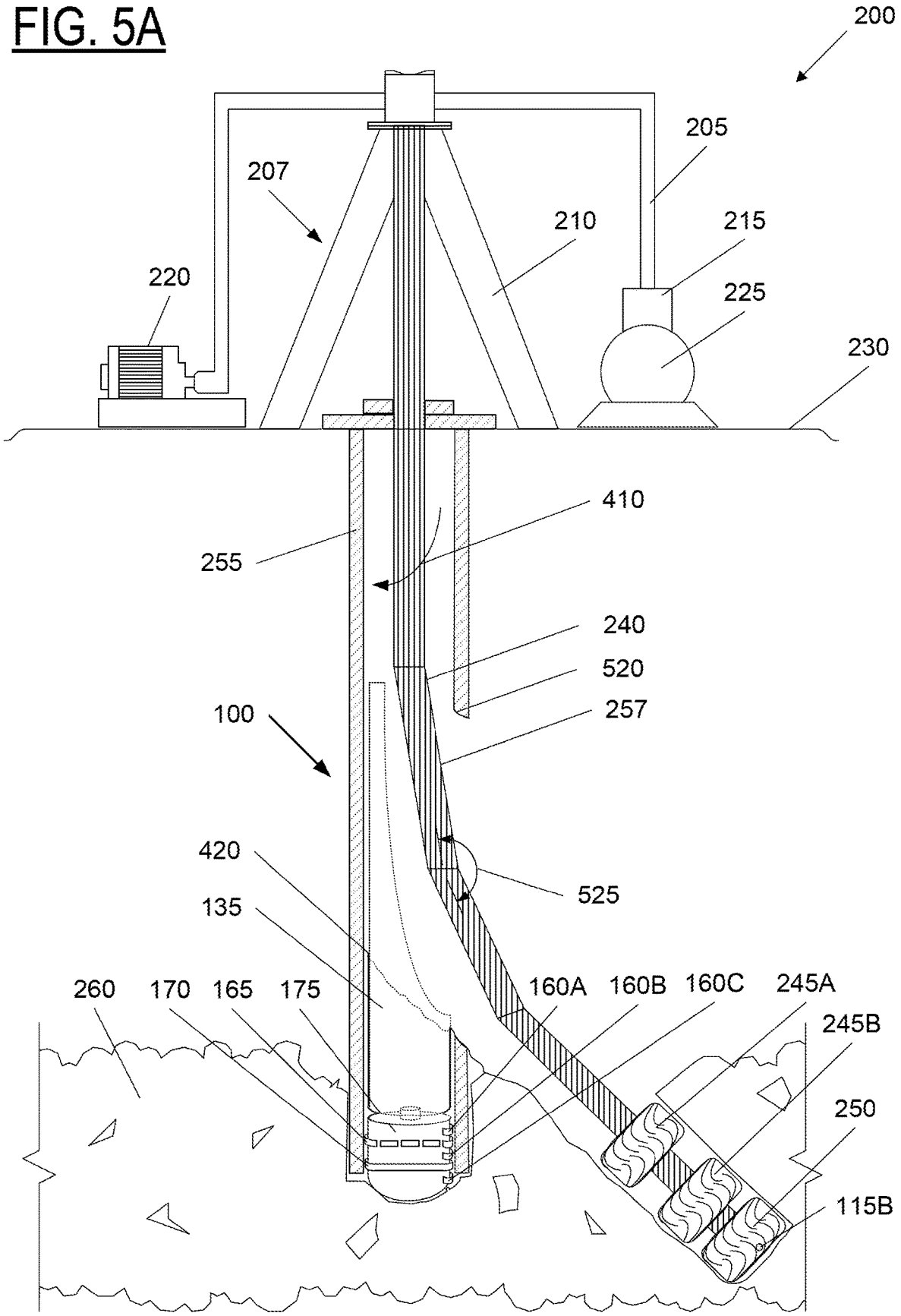
FIG. 5A shows a schematic diagram of a system including an assembly during a milling operation in accordance with one or more embodiments.

FIG. 5A shows a schematic diagram illustrating the casing 255 being milled through during the milling operation according to one or more embodiments. The conveyance mechanism 240 gradually rotates and lowers the watermelon mills 245A and 245B and the window mill 250 as actuated by the actuating devices 220 to mill through the assembly 100. At this point, during the milling operation, the rotating direction 410 is downward, into the well 207, and in a direction of an angle 525. The angle 525 directs the milling operation using the inclined plane 130 to change the movement of the conveyance mechanism 240 into the casing 255. As the milling operation moves through the casing 255 and into the formation 260, the byproduct may include broken casing 520. As the milling operation moves through the casing 255 and into the formation 260, the new lateral wellbore is formed leaving the wellbore 257 (i.e., the original wellbore) abandoned. After successfully milling the casing 255, the milling assembly goes to make a new wellbore in the rock. Once the window has been milled successfully, the milling operation continues by running a directional drilling assembly BHA. This BHA may include a drilling bit, a downhole motor, and real-time deviation and inclination measuring tools.

Figure 5B:
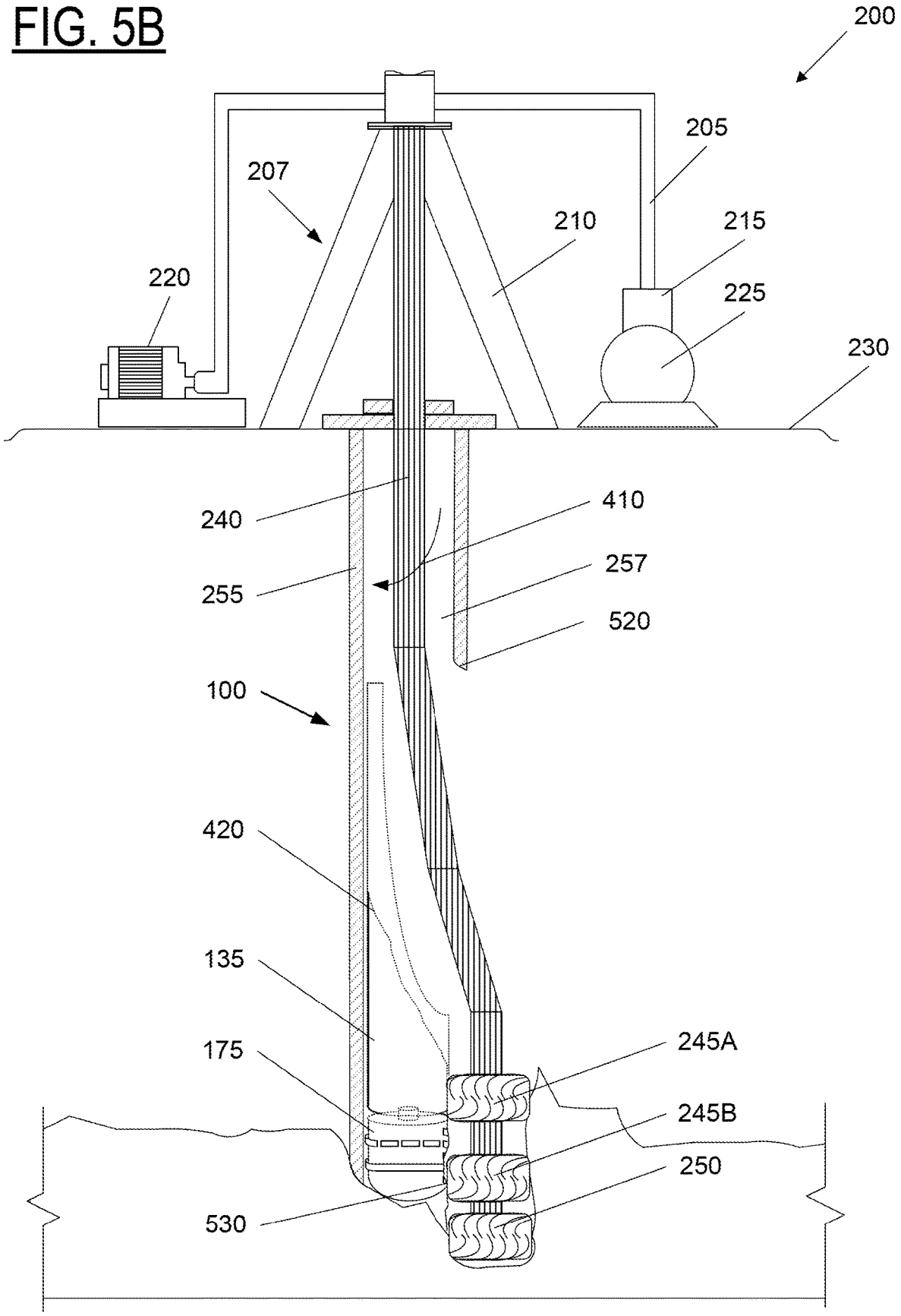
FIG. 5B shows a schematic diagram of a system including an assembly during a milling operation showing casing tracking in accordance with one or more embodiments.

FIG. 5B shows a schematic diagram illustrating the casing 255 being tracked during the milling operation according to one or more embodiments. The conveyance mechanism 240 gradually rotates and lowers the watermelon mills 245A and 245B and the window mill 250 as actuated by the actuating devices 220 to mill through the assembly 100. At this point, the milling path is formed around the outer diameter of the wellbore 257 and tracking the casing 255 (i.e., following the casing tracking path 530). The outer diameter of the casing 255 may be between 7 inches and 10 inches, inclusive. In this situation, the milling assembly may find it easier to continue tracking along the existing casing 255. This situation may occur when the casing 255 or cement is not competent (e.g., as it is the case sometimes with old wells).

In this case, when the bottom of the assembly 100 gets milled, the next assembly to be run (i.e., usually the directional drilling assembly) may not be able to kick-off as it will continue cutting the casing 255. This may cause the drilling assembly to fall back into the original wellbore 257. Further, if the window is not properly milled, then the directional drilling assembly may be damaged given that it would continue cutting along the casing 255.

Figure 5C:
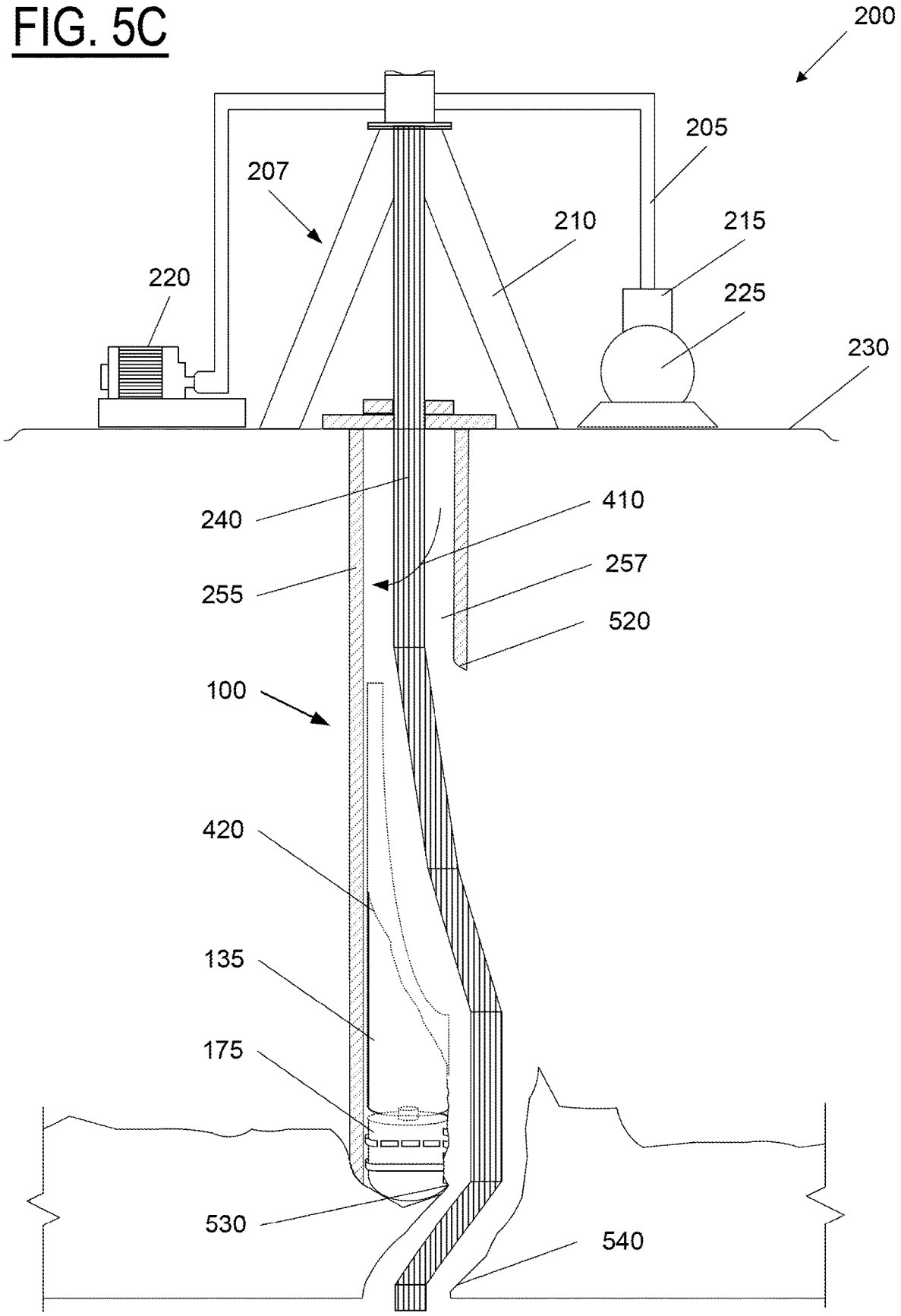
FIG. 5C shows a schematic diagram of a system including an assembly during a milling operation showing failure sidetracking in accordance with one or more embodiments.

FIG. 5C shows a schematic diagram illustrating the casing 255 being tracked during the milling operation according to one or more embodiments. The conveyance mechanism 240 gradually rotates and lowers the watermelon mills 245A and 245B and the window mill 250 as actuated by the actuating devices 220 to mill through and around the assembly 100. At this point, the milling path is formed around the outer diameter of the wellbore 257 and tracking the casing 255 back into the wellbore (i.e., following the casing tracking in failure path 540). In this case, the milling operation is shown in FIG. 5C as a failure sidetrack in which a new lateral wellbore was not formed and the casing 255 has been tracked.

In FIGS. 2-5C, the milling operation is shown to include lowering the assembly 100 using the conveyance mechanism 240 according to one or more embodiments. The control system 225 may include hardware and/or software to identify debris in the byproduct. As the milling operation generates byproduct including the broken casing 520, the control system 225 may determine that the milling operation has broken the assembly 100 or the casing 255. As such, the control system 225 may determine that the window mill 250 has broken the assembly 100 and/or the casing 255. In some embodiments, the assembly 100 is configured for milling the casing 255. As the inclined plane 130 pushes the window mill 250 out of the wellbore 257, the milling goes to the cement behind the casing 255 and finally reaches rock. Milling the cylindrical body 155 of the assembly 100 may be considered a failure. The byproducts identifiable in the returning flow may include milled casing, cement, and rock cuttings. Reading the debris coming back to the surface may not be always easy as the casing shavings are heavy and not all of the shavings may raise to the surface. In this regard, a person of ordinary skill in the art would readily understand that any mill head may be implemented using the conveyance mechanism 240 in the manner described above. Specifically, as it will be described in reference to FIGS. 6-8, some embodiments may use the milling device 620 for performing milling operations. The decision to use one mill head over another may be decided by the control system 225 based on historical data gathered about the well 207. In this case, the mill head determined by the control system 225 may be indicated in a report to an operations team at the well surface 230 in a way that provides the operations team with sufficient notice to replace the mill head on the conveyance mechanism 240.

Figure 6:
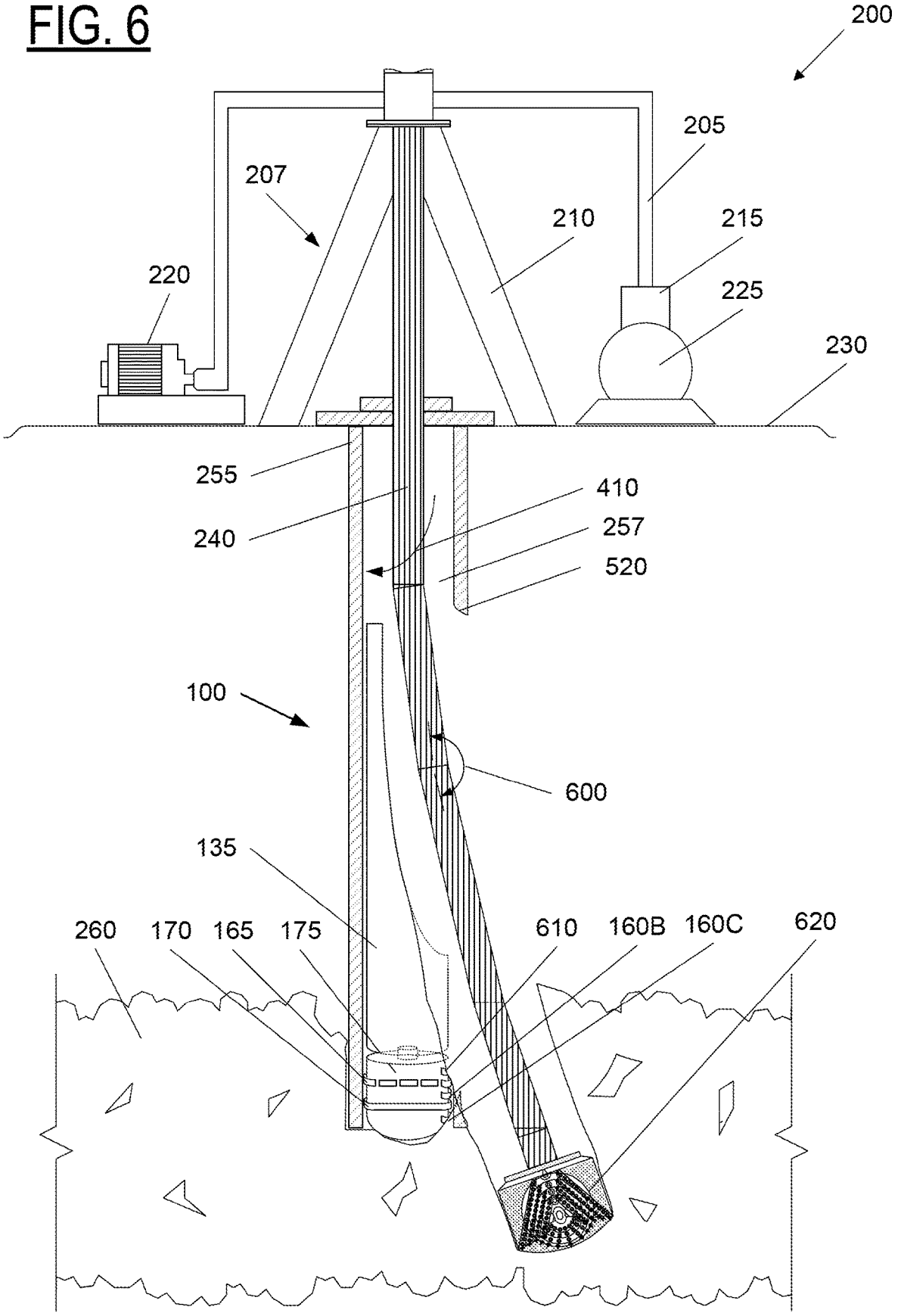
FIG. 6 shows a schematic diagram of a system including an assembly during a milling operation in accordance with one or more embodiments.

FIG. 6 shows a schematic diagram illustrating the assembly 100 being milled through during the milling operation according to one or more embodiments. In particular, the conveyance mechanism 240 may follow a movement in a direction set by a first angle 600, which has caused the milling device 620 to drill through the indicating device 175. At this stage, the milling operation has broken the casing 255 to generate byproduct showing the broken assembly 420 and the broken casing 520, respectively. In FIG. 6, the milling operation has broken the first rubber insert 160A to generate byproduct showing a first broken insert 610. At this point, the control system 225 monitors the byproduct to identify the presence of the first broken insert 610. If the first broken insert 610 is found in the byproduct, the control system 225 may determine that the window is being milled at the first angle 600.

Figure 7:
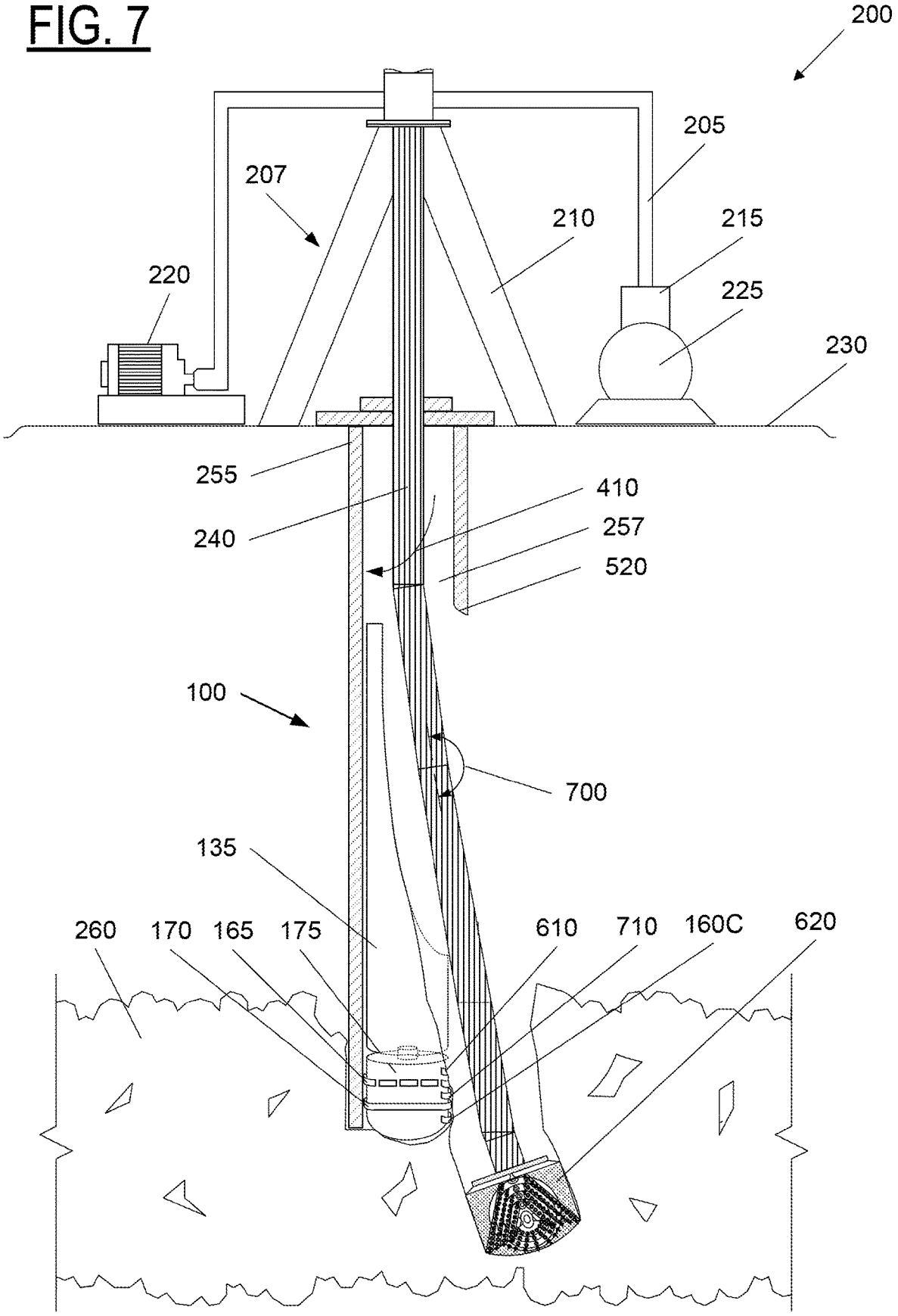
FIG. 7 shows a schematic diagram of a system including an assembly during a milling operation in accordance with one or more embodiments.

FIG. 7 shows a schematic diagram illustrating the assembly 100 being milled through during the milling operation according to one or more embodiments. In particular, the conveyance mechanism 240 may follow a movement in a direction set by a second angle 700, which has caused the milling device 620 to drill through the indicating device 175. At this stage, the milling operation has broken the cylindrical housing 135 and the casing 255 to generate byproduct showing the broken assembly 420 and the broken casing 520, respectively. In FIG. 7, the milling operation has broken the first rubber insert 160A and the second rubber insert 160B to generate byproduct showing the first broken insert 610 and the second broken insert 710, respectively. At this point, the control system 225 monitors the byproduct to identify the presence of the first broken insert 610 and/or the second broken insert 710. If the first broken insert 610 and/or the second broken insert 710 are found in the byproduct, the control system 225 may determine that the window is being milled at the second angle 700.

Figure 8:
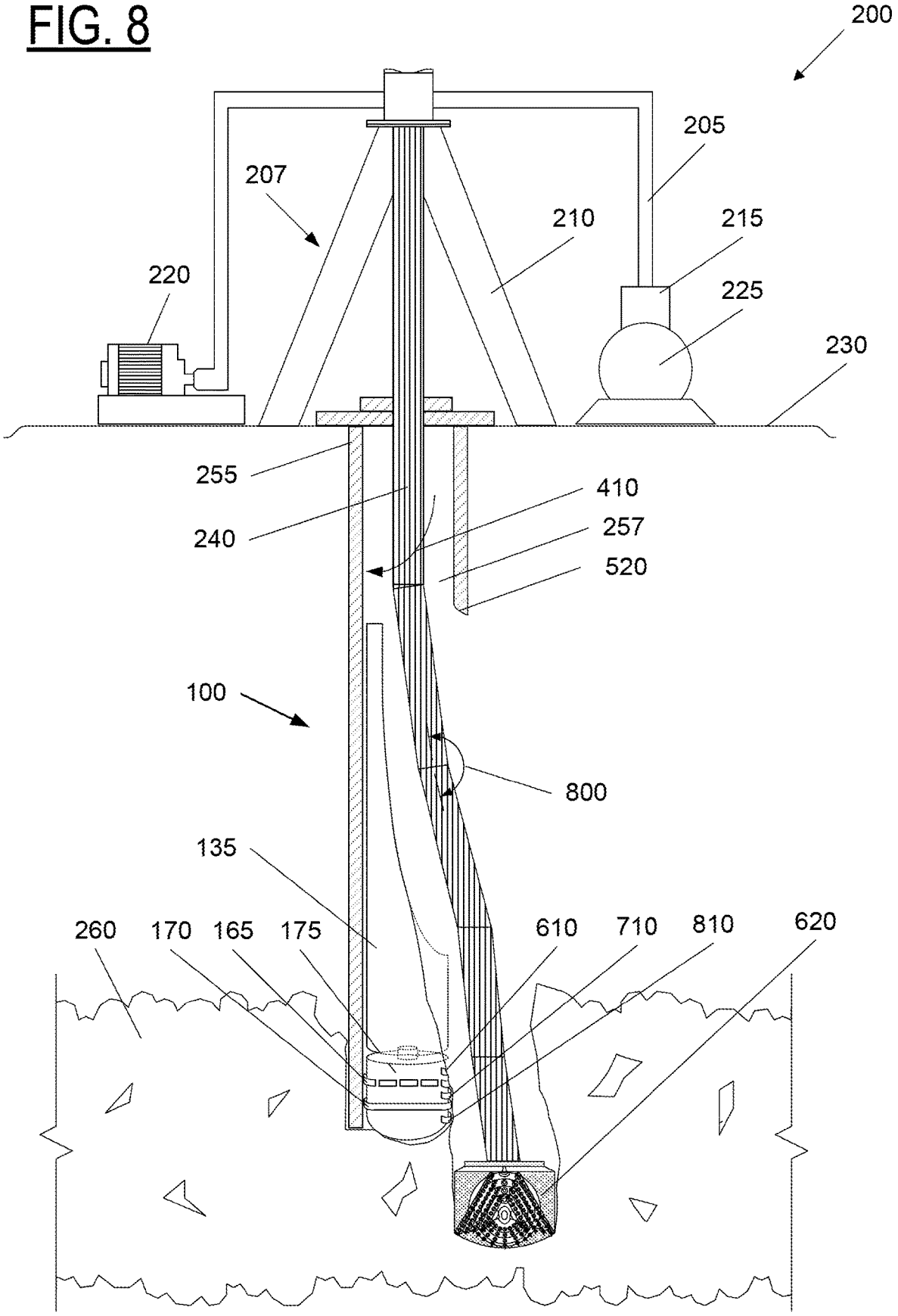
FIG. 8 shows a schematic diagram of a system including an assembly during a milling operation in accordance with one or more embodiments.

FIG. 8 shows a schematic diagram illustrating the assembly 100 being milled through during the milling operation according to one or more embodiments. In particular, the conveyance mechanism 240 may follow a movement in a direction set by a third angle 800, which has caused the milling device 620 to drill through the indicating device 175. At this stage, the milling operation has broken the cylindrical housing 135 and the casing 255 to generate byproduct showing the broken assembly 420 and the broken casing 520, respectively. In FIG. 8, the milling operation has broken the first rubber insert 160A, the second rubber insert 160B, and the third rubber insert 160C to generate byproduct showing the first broken insert 610, the second broken insert 710, and the third broken insert 810, respectively. At this point, the control system 225 monitors the byproduct to identify the presence of the first broken insert 610, the second broken insert 710, and/or the third broken insert 810. If the first broken insert 610, the second broken insert 710, and/or the third broken insert 810 are found in the byproduct, the control system 225 may determine that the window is being milled at the third angle 800.

In FIGS. 6-8, the broken inserts 610, 710, and 810 are representative of different window mills at different depths of the wellbore 257. As such, the byproduct resulting from the milling operation may be studied to identify an angle in which the window and the final exit trajectory have been milled. The inserts 160A-160B that result in the broken inserts 610, 710, and 810 may be of different colors or textures according to their location on the identifying device 175. For example, a first color or texture may be located between the inclined plane 130 and the anchor slips 165, a second color or texture may be located between anchor slips 165 and the packer 170, and a third color or texture may be located at a bottom of the indicating device 175. The dimensions of the inserts 160A-160B may be large enough to be detected with the returning flow of milling fluid from the milling operation. Similarly, the angles 600, 700, and 800 may be between 2 to 5 degrees, inclusive, when measured from the central axis 125.

In some embodiments, the dimensions for the inserts 160A-160C are based on one or more milling operation requirements. A width of the inserts 160A-160C may be between 1 inch and 6 inches, inclusive. More specifically, a width of the inserts 160A-160C may be between 3 inch and 4 inches, inclusive. A length of the inserts 160A-160C may be between ¼ inch and 3 inches, inclusive. A length of the inserts 160A-160C may have a minimum length of 2 inches to cover at least 6 ft of length for each insert. A thickness of the inserts 160A-160C may be between ½ inch and 1 inch, inclusive. In some embodiments, inserts with a width of 3 inches, a length of 2 inches and a thickness of ⅛ inch may be used to cover a minimum area of 6 squared inches for each insert on the indicating device 175. As noted above, these dimensions may be modified if deemed that larger (or smaller) inserts are required for easier detection. The inserts 160A-160C provide a positive indication of a deepest point at which the exit happened. The positive indication may be information used to determine that the milling process is normal and it should proceed as planned, to determine tracking casing is mild while considering a more conservative sidetracking BHA for a following attempt, or to determine casing tracking is severe while needing to plan for remedial jobs and to be ready with a contingency whipstock.

An example of possible dimensions are shown in Table 1 below. In particular, Table 1 includes possible dimensions for the existing casing 255 to the mill window, the length of the assembly 100, the maximum outer diameter 185 of the assembly 100, a face angle of the inclined plane 130 (that is measured from a plane orthogonal to the central axis 125 and complementing of the angle 127), and a length 110 of the cylindrical housing 135.

TABLE 1

| | | |
|---|---|---|
| Existing Casing 255 | 9-⅝ inches | 7 inches |
| Length of Assembly 100 | 22 feet-31 feet | 20 feet-26 feet |
| Max. Outer Diameter 185 | 8 inches-8-⅛ inches | 5-⅜ inches-5-½ inches |
| Face Angle of Inclined Plane 130 | 2 degrees-3 degrees | 2 degrees-3 degrees |
| Length 110 | 12 feet-20 feet | 13 feet-8 feet |

Figure 9:
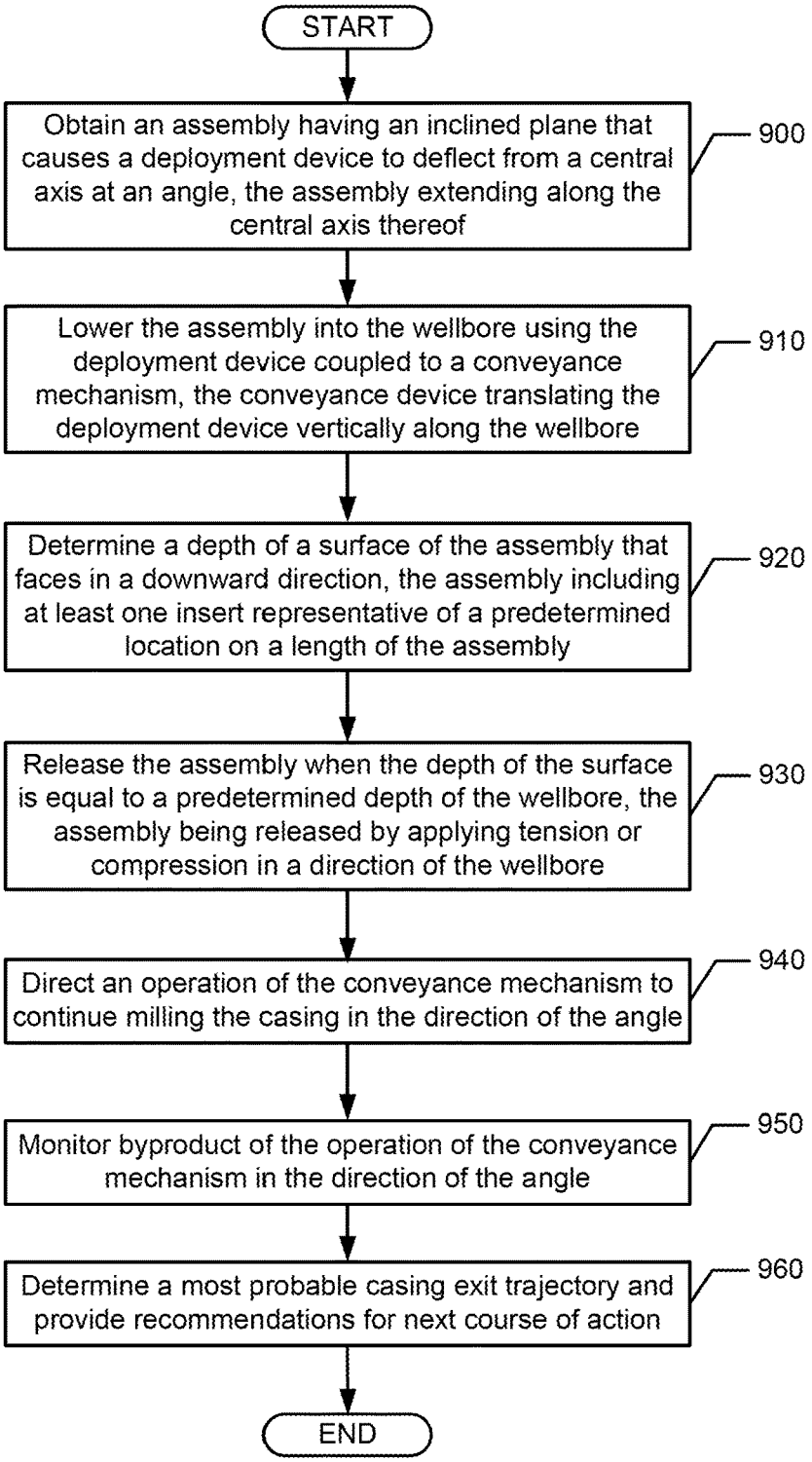
FIG. 9 shows a flowchart in accordance with one or more embodiments.

FIG. 9 shows a flowchart in accordance with one or more embodiments. Specifically, FIG. 9 describes a method for indicating window milling in the well 207 using the assembly 100, the conveyance mechanism 240, and the control system 225 described in reference to FIGS. 1-8. In this case, FIG. 9 is illustrative of a process in which some casing tracking occurs. One or more blocks in FIG. 9 may be performed by one or more components as described in FIGS. 1-8 (e.g., the actuating devices 220 coupled to the conveyance mechanism 240 and the control system 225). While the various blocks in FIG. 9 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 900, the assembly 100 is obtained. The assembly 100 includes the inclined plane 130 that causes a deployment device, such as the window mill 250, to deflect from the central axis 125 at the angle 127. As explained above, the assembly 100 extends along the central axis 125 and includes the cylindrical housing 135 and the indicating device 175 coupled through the coupling mechanism 150.

In Block 910, the assembly 100 is lowered into the wellbore 257 using the deployment device. For example, the window mill 250 may be coupled to the conveyance mechanism 240 through the shear bolt 115 allowing for the conveyance mechanism 240 to control the vertical translation of the assembly 100 along the wellbore 257 of the well 207. The assembly 100 may be lowered at a speed rate (i.e., acceleration) determined by the control system 225 such that the assembly 100 may reach a predetermined depth without breaking the shear bolt 115.

In Block 920, the control system 225 determines a depth of the surface 180 of the indicating device 175. As noted above, the surface 180 is located at the bottommost portion of the assembly 100 such that the surface 180 faces in the downward direction 235. In particular, the surface 180 is located below at least one insert 160A, 160B, or 160C. The assembly 100 includes the indicating device 175 including the inserts 160A-160C. As such, when the assembly 100 is placed in the wellbore 257, the assembly 100 is oriented such that the inclined plane 130 is oriented the required direction by means of a non-magnetic or accelerometers surveying tool and is set by hydraulically activating the anchor slips 165 and the packer 170.

In Block 930, the assembly 100 is released by the deployment device by using a hydraulically activated mechanism (not shown). The conveyance mechanism 240 is released by applying compression and shearing the bolt 115. As the conveyance mechanism 240 moves, the shear bolt 115 breaks into two portions or shear bolt elements 115A and 115B effectively separating the assembly 100 from the deployment device. For example, as shown in FIG. 3, the window mill 250 may move in the direction 310 for orienting the assembly 100. After the assembly 100 is oriented, the conveyance mechanism 240 is actuated to release the assembly 100 at a predetermined depth of the wellbore 257 in which the assembly 100 is held by the frictional forces of the anchoring slips around the indicating device 175 and/or the surface 180.

In Block 940, the direction of the conveyance mechanism 240 follows the inclined plane 130, that pushes the milling assembly against the casing 255 to open the window in that direction, once the deployment device has reached the inclined plane 130. At this point, the control system 225 determines whether to turn the window mill 250 in the direction of the angle 127. As such, the operation of the conveyance mechanism 240 is directed to continue milling the casing in the direction of the inclined plane 130.

In Block 950, the control system 225 monitors the byproduct generated by the milling operation. In the byproduct, when casing tracking occurs, the control system 225 identifies broken elements of the well system 200 and determines progress of the milling operation based on the elements found. For example, if the control system 225 identifies the broken assembly 420, the control system 225 determines that at least the upper end 120 of the assembly 100 has been engaged by the window mill 250. If the control system 225 identifies the broken casing 520, the control system 225 determines that the casing 255 has been milled. If the control system 225 identifies the first broken insert 610, the control system 225 determines that the window mill 250 has broken the indicating device 175 at the first angle 600. If the control system 225 identifies the second broken insert 710, the control system 225 determines that the window mill 250 has broken the indicating device 175 at the second angle 700. If the control system 225 identifies the third broken insert 810, the control system 225 determines that the window mill 250 has broken the indicating device 175 at the third angle 800.

In Block 960, the control system 225 determines a most probable casing exit trajectory and provides recommendations for a next course on action. The control system 225 may identify the milling trajectory while evaluating one or more parameters associates with a depth of the milling assembly. As such, the milling assembly may be positioned with respect to a specific depth in the casing 255 to determine whether a window is being milled properly.

In one or more embodiments, as milling continues, the control system 225 generates a report including the presence of at least one insert 160A, 160B, or 160C in the byproduct of the milling operation. At this point, the control system 225 may determine that has occurred in the assembly 100 when colors or textures associated the inserts 160A-160C show that the milling operation is cutting the assembly 100 below an end of the inclined plane 130 of the assembly 100. In this regard, the control system 225 determines that the presence of the first broken insert 610 in the byproduct indicates that the window was properly milled and the rat-hole was drilled mainly outside the wellbore 257. Further, the control system 225 determines that the presence of the second broken insert 710 in the byproduct indicates that partial tracking occurred in the assembly 100 and that special actions should be taken with conveyance mechanism 240. Special actions refer to changes in the next steps needed to complete milling. In addition, the control system 225 determines that the presence of the third broken insert 810 in the byproduct indicates that severe tracking occurred in the assembly 100 and that remedial actions should be taken either by selecting a different directional drilling Bottom Hole Assembly (BHA) and drill bit, by deciding for an advanced remedial job, or by restarting the milling process. Remedial actions refer to changes in the next steps needed to complete milling and including replacing or restarting the milling process.

As noted above, the early indications of tracking in the assembly 100 allow for proper planning of the next steps to avoid any damage of expensive drilling bits and to reduce the time required to perform remedial operations. When Re-entering old wells, across consolidated formations, the existing condition of the casing 255 is not always ideal for cutting a smooth window. In some instances, the milling tools for the casing 255 make it easier to continue along the casing 255 instead of kicking off from the existing wellbore 257.

As noted above the method described in blocks 900-970 provides early indications of tracking in the assembly. In this regard, the method allows for proper planning of next steps in the milling operations. These next steps may be to avoid any additional damage of expensive drilling bits and may be to reduce time required to perform remedial operations. Timing for implementing sidetracks for re-entering existing wellbores and target new zones in same or different reservoirs may be greatly improved as a result. Specifically, traditional re-entry operations may require between 6 to 8 days to fix when severe tracking occurs in milling operations. In some embodiments, re-entry operations may be fixed in under a couple of days using the assembly and the indicating device 175 described herein.

While FIGS. 1-9 show various configurations of components, other configurations may be used without departing from the scope of the disclosure. For example, various components in FIGS. 1-8 may be combined to create a single component. As another example, the functionality performed by a single component may be performed by two or more components.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed is:

1. An assembly for indicating window milling in a well, the assembly comprising:

a cylindrical housing having an inclined plane that extends along a central axis thereof, the inclined plane extending from a lower end to an upper end of the cylindrical housing;

an indicating device comprising:

a cylindrical body having a surface that faces in a downward direction, a plurality of anchor slips located on a curved rectangular side of the cylindrical body, and a first insert located at a first predetermined location along a length of the curved rectangular side of the cylindrical body, a second insert located at a second predetermined location along the length of the curved rectangular side of the cylindrical body, the second predetermined location being located below the first predetermined location, a third insert located at a third predetermined location along the length of the curved rectangular side of the cylindrical body, the third predetermined location being located below the second predetermined location, wherein the first, the second, and the third inserts are color-coded to represent their respective predetermined locations; and a coupling mechanism that connects the indicating device to the cylindrical housing.

2. The assembly according to claim 1, wherein the indicating device further comprises a packer located along an outer diameter of the curved rectangular side of the cylindrical body.

3. The assembly according to claim 2, wherein the first, the second, and the third inserts are made of rubber, and wherein the indicating device is an anchoring device that uses the plurality of anchor slips and the packer to avoid vertical translation and rotational translation of the assembly along the well during milling operations.

4. The assembly according to claim 2, wherein the first, the second, and the third inserts and the packer are color-coded to indicate tracking in the cylindrical body of the indicating device during window milling operations.

5. The assembly according to claim 1, wherein an outer diameter of the cylindrical housing of the assembly is equal or smaller than an outer diameter of the cylindrical body.

6. The assembly according to claim 1, wherein a length of the cylindrical housing is equal or larger than the length of the length of the curved rectangular side of the cylindrical body.

7. An indicating device for indicating window milling in a well, the device comprising:

a cylindrical body having a surface that faces in a downward direction;

a plurality of anchor slips located on a curved rectangular side of the cylindrical body;

a first insert located at a first predetermined location along a length of the curved rectangular side of the cylindrical body;

a second insert located at a second predetermined location along the length of the curved rectangular side of the cylindrical body, the second predetermined location being located below the first predetermined location, a third insert located at a third predetermined location along the length of the curved rectangular side of the cylindrical body, the third predetermined location being located below the second predetermined location, wherein the first, the second, and the third inserts are color-coded to represent their respective predetermined locations, wherein the indicating device connects to a cylindrical housing through a coupling mechanism, the cylindrical housing having an inclined plane that extends along a central axis thereof, the inclined plane extending from a lower end to an upper end of the cylindrical housing.

8. The device according to claim 7, wherein the indicating device further comprises a packer located along an outer diameter of the curved rectangular side of the cylindrical body.

9. The device according to claim 8, wherein the first, the second, and the third inserts are made of rubber, and wherein the indicating device is an anchoring device that uses the plurality of anchor slips and the packer to avoid vertical translation and rotational translation of the assembly along the well during milling operations.

10. The device according to claim 8, wherein the first, the second, and the third inserts and the packer are color-coded to indicate tracking in the cylindrical body of the indicating device during window milling operations.

11. The device according to claim 7, wherein an outer diameter of the cylindrical housing is equal or smaller than an outer diameter of the cylindrical body.

12. The device according to claim 7, wherein a length of the cylindrical housing is equal or larger than the length of the length of the curved rectangular side of the cylindrical body.

13. A method for indicating window milling in a well, the method comprising:

obtaining an assembly having an inclined plane that causes a deployment device to deflect from a central axis at an angle, the assembly extending along the central axis thereof;

lowering the assembly into the wellbore using a deployment device coupled to a conveyance mechanism, the conveyance device translating the deployment device in an original direction of the wellbore;

determining a depth of a surface of the assembly that faces in a downward direction, the assembly including at least one insert representative of a predetermined location along a length of the assembly;

releasing the assembly when the depth of the surface is equal to a predetermined depth of the wellbore, the assembly being released by the conveyance mechanism back and forth;

gradually lowering the conveyance mechanism, the conveyance mechanism causing the deployment device to engage an upper end of the assembly;

directing an operation of the conveyance mechanism in a direction of the angle; and monitoring byproduct of the operation of the conveyance mechanism in the direction of the angle, wherein the assembly comprises:

a cylindrical housing having an inclined plane that extends along a central axis thereof, the inclined plane extending from a lower end to an upper end of the cylindrical housing;

an indicating device comprising:

a cylindrical body having a surface that faces in a downward direction, a plurality of anchor slips located on a curved rectangular side of the cylindrical body, a first insert located at a first predetermined location along a length of the curved rectangular side of the cylindrical body, a second insert located at a second predetermined location along the length of the curved rectangular side of the cylindrical body, the second predetermined location being located below the first predetermined location, and a third insert located at a third predetermined location along the length of the curved rectangular side of the cylindrical body, the third predetermined location being located below the second predetermined location, wherein the first, the second, and the third inserts are color-coded to represent their respective predetermined locations; and a coupling mechanism that connects the indicating device to the cylindrical housing.

14. The method according to claim 13, wherein the indicating device further comprises a packer located along an outer diameter of the curved rectangular side of the cylindrical body.

15. The method according to claim 14, wherein the first, the second, and the third inserts are made of rubber, and wherein the indicating device is an anchoring device that uses the plurality of anchor slips and the packer to avoid vertical translation and rotational translation of the assembly along the well during milling operations.

16. The method according to claim 14, wherein the first, the second, and the third inserts and the packer are color-coded to indicate tracking in the cylindrical body of the indicating device during window milling operations.

* * * * *